United States Patent [19]

Weltman et al.

[11] Patent Number: 4,508,403

[45] Date of Patent: Apr. 2, 1985

[54] LOW PROFILE IC TEST CLIP

[75] Inventors: David Weltman, Millwood; Pyotr Tsipenyuk, Bronx, both of N.Y.

[73] Assignee: O.K. Industries Inc., New York, N.Y.

[21] Appl. No.: 553,853

[22] Filed: Nov. 21, 1983

[51] Int. Cl.[3] ..... H01R 13/639

[52] U.S. Cl. ..... 339/28; 339/17 CF; 339/75 MP; 339/91 R

[58] Field of Search ..... 339/17 CF, 75 M, 75 MP, 339/176 M, 176 MP, 91 R, 28; 324/158 F

[56] References Cited

U.S. PATENT DOCUMENTS

| | | | |
|---|---|---|---|
| 3,551,878 | 12/1970 | Rossman | 339/17 CF |
| 3,701,077 | 10/1972 | Kelly, Jr. | 339/17 CF |
| 3,725,842 | 4/1973 | Feldberg | 339/17 CF |
| 4,113,179 | 9/1978 | McKee | 339/91 R |
| 4,257,028 | 3/1981 | Narozny et al. | 339/17 CF |

*Primary Examiner*—John McQuade

[57] ABSTRACT

A novel low profile IC test clip for removable attachment to a DIP IC having substantially fixed contacts for sliding engagement with the IC pins, locking means at the ends, which are uncoupled to the contacts, and a laterally extending multi-conductor cable internally connected to the contacts.

13 Claims, 5 Drawing Figures

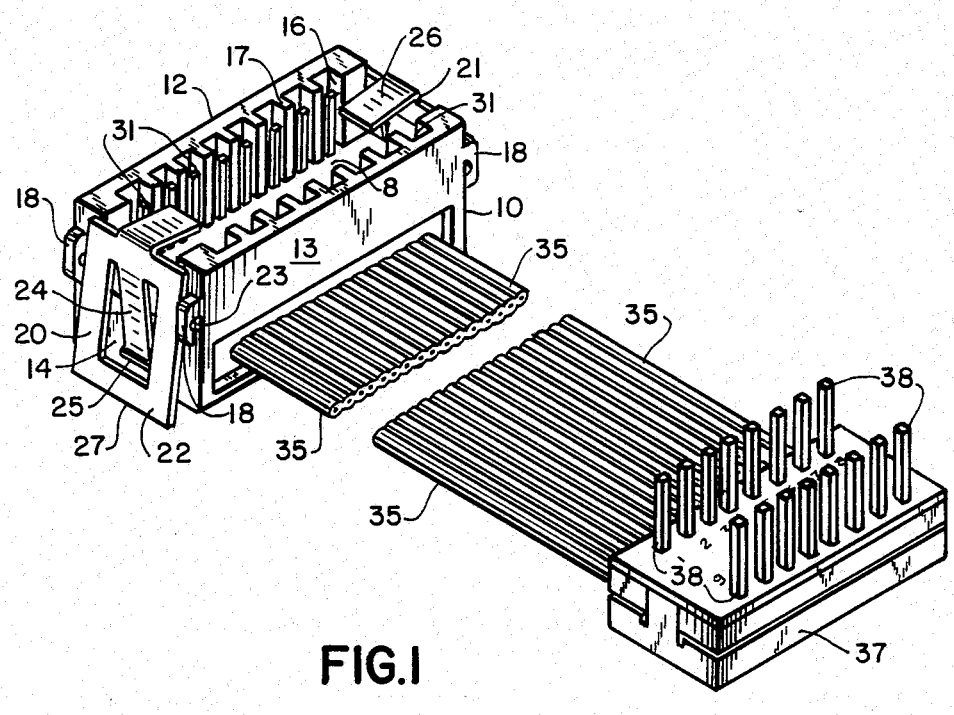
FIG.1
FIG.2
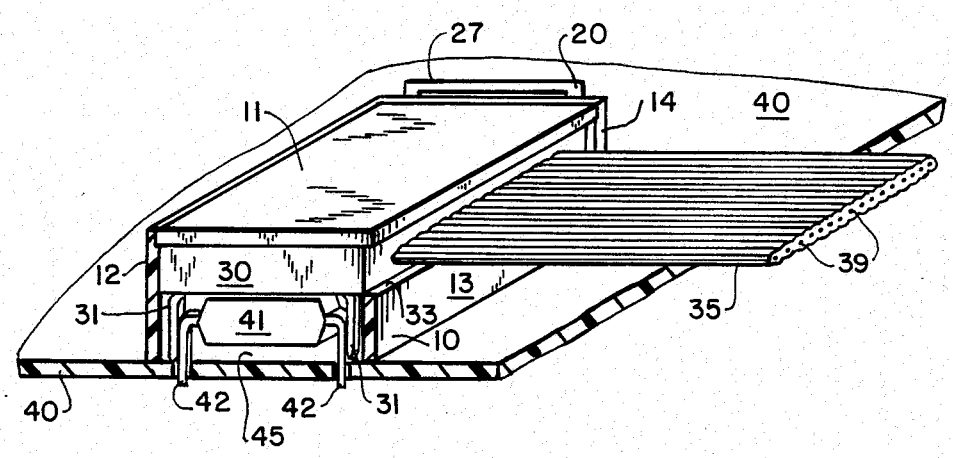

LOW PROFILE IC TEST CLIP

This invention relates to test clips for electrical components, and more particularly to test clips for Dual-In Line Package (DIP) type integrated circuits (ICs).

BACKGROUND OF THE INVENTION

A known test clip for DIP ICs employs a clothes-pin type spring-loaded construction which, when opened, laterally spreads the clip contacts so it can be fitted over the IC housing and, when released, spring biases the electrical clip contacts into contact with the IC pins protruding from the IC socket typically mounted on a printed circuit board (PCB). The test clip contacts extend vertically through the clip structure and are accessible at the top to the engineer or technician who desires to conduct tests or measurements of the IC while in service. In this construction, the two rows of clip contacts move laterally or transverse to the longitudinal axis of the IC package, i.e., in planes transverse to the IC pin rows. In another known test clip, the central clip contacts are not movable when the spring-loaded members are actuated, but the clip contacts at opposed ends move outwardly or longitudinally in the plane of the IC pin rows for the purpose of hooking the end clip contacts to the end IC pins to lock the clip to the IC package.

Both known constructions suffer from the disadvantage that, due to the spring-biased clothes-pin type construction, the height of the resultant clip, measured orthogonally to the PCB, is considerable, typically 1½ inches or more. As a result, such clips cannot be easily clipped onto ICs on PCBs mounted parallel to one another on a mother board with relatively small inter-PCB spacings. Moreover, even when mounted on the IC, the use of such clips is sometimes obstructed by the presence of adjacent components on the PCB. In addition, the application of the spring loading directly to the IC pins can sometimes unduly stress the pins causing damage and eventual breakage.

BRIEF DESCRIPTION OF THE INVENTION

A principal object of the invention is a novel IC test clip having a low profile, I.E., a small height measured in a direction orthogonally to the PCB when in use.

Another object of the invention is a novel IC test clip constructed to enable straight-line push-on use when attached to a DIP IC.

Still another object of the invention is a novel IC test clip not requiring significant movement of the clip contacts in order to attach same to a DIP IC, yet enabling the clip to be locked to the IC package.

A further object of the invention is a novel IC test clip construction which avoids imparting undue stresses to the IC pins during attachment thereto or removal therefrom.

Another object of the invention is a novel cable connected test clip which reduces or eliminates the likelihood of poor electrical connections at the IC or at the test station.

Still a further object of the invention is a low profile cable connected IC test clip which is of low cost construction and simple to manufacture.

These and other object and advantages are obtained in accordance with the invention with a test clip construction wherein the clip contacts are essentially fixed, with just enough inter-row space to enable the clip to be slid over the IC pins with only slight spring tension. A simple spring-biased lock is provided on the clip to enable the lock ends to be fitted under the IC package ends, not in contact with the pins, to positively lock the clip to the IC. As a result of this novel construction, the height of the clip can be substantially reduced providing a low-profile configuration.

In accordance with another aspect of the invention, a multi-conductor cable is permanently attached to the clip contacts, the free cable end being used to receive the measuring instrument probes or test leads. This eliminates the possibility of poor electrical connections and minimizes resistance at the cable connector.

In accordance with still another aspect of the invention, the test clip comprises a multi-conductor flat cable fitted with connectors at opposite ends, one of the connectors being mounted within a housing fitted with user-actuable locks and configured such that the connector pins are exposed within a cavity of the housing and will contact the IC pins when the housing is slid over and locked to the IC package.

BRIEF DESCRIPTION OF THE DRAWINGS

The invention will now be described in connection with one exemplary embodiment taken in conjunction with the accompanying drawings, wherein:

FIG. 1 is a perspective view of one form of test clip of the invention, shown inverted in order to depict inside structure more clearly;

FIG. 2 is a perspective view of the test clip of FIG. 1 upright, shown in use with an IC on a PCB, and with the front side of the clip removed to show interior details;

DETAILED DESCRIPTION OF PREFERRED EMBODIMENT

Figure 3:
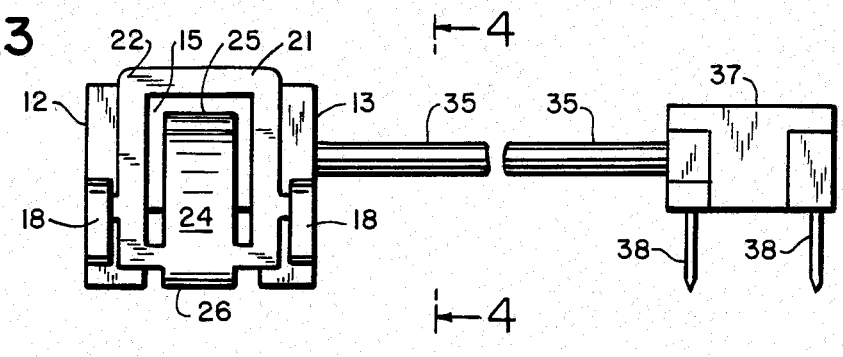
FIG. 3 is an upright side view of the clip of FIG. 1.

Referring now to the drawings, of which FIG. 1 is a perspective view of one form of the device of the invention, shown inverted, and FIG. 2 shows the device in use with one of the side pieces removed, the device comprises an insulating housing body part 10 in the form of a generally rectangular box open at the bottom (at the top in the inverted view of FIG. 1) to form a cavity 8. The housing 10 comprises a top cover 11, opposed side walls 12, 13, and opposed end walls 14, 15. Preferably, the housing is formed of molded plastic. The interior surfaces of the side walls 12, 13 are configured to form parallel slots 16 defined by parallel wall projections 17 which face one another. These slots 16 will accommodate the contact pins. Each side wall also has at opposite ends ear-shaped lugs 18. The end walls 14, 15 are flat.

Figure 4:
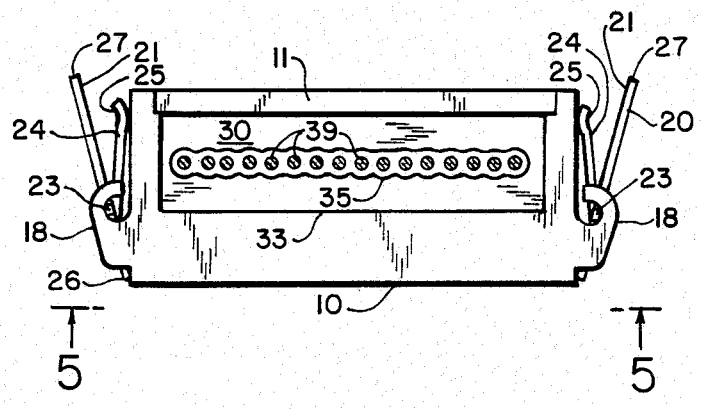
FIG. 4 is a sectional view of the clip of FIG. 3 taken along the line 4—4.
Figure 5:
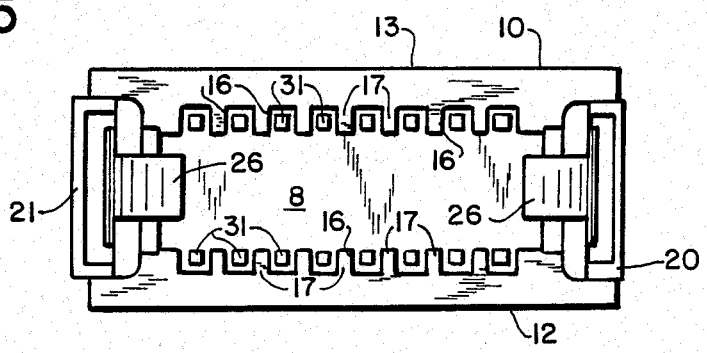
FIG. 5 is a bottom view of the clip of FIG. 4 taken along the line 5—5.

Secured within the adjacent lugs 18 at opposite ends are two metal parts 20, 21 of spring metal, each of which comprises a generally rectangular frame 22 having side projections 23 shaped to engage the housing ears 18, a central tang part 24 offset from the plane of the frame 22 and engaging with its end 25 the adjacent side wall and spring biasing a bottom (top in FIG. 1) inwardly projecting locking tab 26 to its innermost position as illustrated wherein the tab 26 projects over the cavity 8 (FIG. 5). When the frame tops 27 are pressed toward one another, the frame 22 pivots on its projections 23 and the locking tab 26 moves outwardly (laterally in FIG. 4).

A cable connector 30, male end, is mounted within the housing 10, such that its two rows of metal pins 31 fit within the parallel slots 16 formed along the interior of the housing side walls 12, 13. The pins 31 are internally connected to a flat multi-conductor insulated cable 35 which extends laterally out of the side of the connector 30 and through a rectangular opening 33 in the housing side wall 13. The opposite end of the flat cable terminates in a remote similar male connector 37 from which protrude two rows of pins 38 in a similar configuration. Each pin 38 of the terminating connector 37 is connected by way of a cable conductor 39 to a corresponding one of the pins of the first connector 30 within the housing 10.

The device shown, in the preferred embodiment, is constructed as follows. The housing unit, with cover removed, is molded. The double male connector ended flat cable can be purchased commercially from various suppliers as a standard component. The first connector end 30 is positioned from the open top within the molded housing unit such that its pins 31 are centrally located within the slots 16, and it is then glued in place. The cover member 11 is mounted on top and also glued in place, thereby enclosing the connector within the housing with the connector cable 35 extending out through the housing opening 33. Finally, the spring metal parts 20, 21 are snapped into the ears 18, producing the completed assembly shown in the drawings.

FIG. 2 illustrates its use. A PCB 40 is shown on which is mounted an IC 41 in a DIP package. The testing device of the invention is pushed over the IC package as shown while the end springs 20, 21 held between the user's thumb and forefinger are depressed. The end wall 15 of the device has been removed in FIG. 2 to show the action of the connector pins 31 each of which contacts an adjacent pin 42 of the IC. Since the lateral center-to-center connector pin spacing is the same as that of the IC, as both are configured to plug into the same socket, due to the pin thickness, the fixed IC pins push outwardly the connector pins as the test clip is slid over the package, so that the connector contact pins 31 slide over the IC pins 42 with a slight spring tension. No clothespin type action is present. The straight line push-on design provides a sliding action between the test clip pins 31 and the IC pins 42 that provides a positive electrical connection between the two and a true wiping action to minimize resistance, while at the same time avoiding the application of an undue stress to the IC pins. The permanent attachment of the cable 35 to its connectors 30, 37 eliminates any possibility of a poor electrical connection between the cable conductors 39 and the connector pins at opposite ends. When the user releases the end springs 20, 21, the spring bias of the tang 24 moves the locking tab ends 26 inwardly, and they each pass into the space designated 45 that exists between the bottom surface of the IC package 41 and the top of the PCB 40. The locking tabs 26 which are spaced and uncoupled and unconnected to the test clip pins 31 thus press against and under the IC package ends, away from its pins, and firmly locks the test clip 10 to the IC 41. The test clip 10 is easily removed by the user pressing again the end springs 20, 21 to release or unlock the tabs 26 from the IC and lifting the device off the IC.

The inner side wall projections 17 which flank each contact pin 31 serve to prevent the contact pins 31 from being bent or displaced sideways toward one another and thereby maintains each contact pin 31 properly vertically oriented with the IC pin it is to engage and during engagement. The rear slot wall limits the outward displacement of the contact pins 31 from which it is slightly spaced. This configurating of the housing side wall inner surfaces makes it comparatively simple to incorporate a standard, commercially-available, cable connector 30 within the housing 10 to serve the electrical contacting function to the IC pins. Since the cable connector 30 is designed to be plugged into a standard IC socket, its pin spacings will match that of the IC. Due to the pin thicknesses, and since the usual lateral spacing of the socket or PCB openings is such as to slightly bend outwardly the normally slightly bent inwardly IC or connector pins when plugged into the openings, this cooperation ensures the desired positive electrical contact between the applied test clip pins and the socketed or PCB-mounted IC pins but without unduly stressing the latter. Hence, assembly of the preferred embodiment is extremely simple and of low cost. However, it is within the contemplation of the invention that the incorporated cable connector can be substituted by any equivalent construction that provides rows of vertical pins aligned with the slots and connected at their ends to a cable that extends through the side of the housing to provide the low profile configuration.

While a user can apply test probes directly to the pins 38 of the remote cable connector 37 in order to, for example, measure voltages or display waveforms on suitable test instruments, for which purpose the pins may be numbered as depicted in FIG. 1, the presence of the remote cable connector 37 allows the user to plug same into the socket of a suitable testing fixture connected to a suitable instrument which allows certain tests to be carried out manually or automatically, optimum electrical connections between the tester and the IC being automatically achieved due to the permanent cable connections established to the end connectors and by way of the connector sockets employed.

Among the advantages of the inventive clip are its low or shallow height, which permits on-line testing of the IC even in card (PCB) frame arrangements with another PCB closely alongside the board containing the IC to be tested. In a commercial embodiment being marketed, the height of the clip 10 is about one-half inches. Its straight-line push-on operation with fixed contacts makes for simple, low-cost construction, prevents undue stress to the ICs, and the sliding engagement of the clip contacts to the IC pins in conjunction with the slight spring tension of the clip contacts provides positive contact and true wiping action which cleans off dirt or contamination and improves the contact. The simple spring locks under the IC package ends, uncoupled to the IC pins, does not stress the IC pins and prevents the clip from accidentally slipping off the IC in use. The laterally-extending, permanently attached flexible cable, maintains the low profile and eliminates the possibility of poor connections to the clip contacts and minimizes resistance at the cable connector, which can be simply plugged into a matching connector of the instrument. As is further evident from the detailed description, a relatively simple, low cost construction results which lends itself to high production levels with low manufacturing cost.

While the invention has been described in connection with one exemplary embodiment employing 16 contacts for use with a 16 pin DIP IC, it will be evident to those skilled in the art that it can easily be shortened or lengthened for use with 8-pin to 64-pin DIP ICs, and also given other configurations to accommodate other shapes and sizes of IC packages and pin-outs. Further, while the simple locking means described is preferred, other locking constructions which allow the clip to be safely removably attached to the IC package without connecting to or unduly stressing the IC pins will also be evident to those skilled in this art.

It is preferred, though not essential, to provide an insulating coating over the end spring metal parts 20, 21 to prevent inadvertent electrical shorting of PCB or component connections during application or removal of the test clip, by the bare metal touching of such connections. This will not interfere with the spring action, and is easily obtained by means of a plastisol coating of the parts 20, 21 before assembly. Also, to provide additional resilient back-up of the connector pins 31 should they lack adequate restoring force, if desired and as an optional alternative, a thin layer of springy material, such as foam plastic, can be mounted on the inner surface of each slot 16 behind each contact pin 31.

While my invention has been described in connection with specific embodiments thereof, those skilled in the art will recognize that various modifications are possible within the principles enunciated herein and thus the present invention is not to be limited to the specific embodiments disclosed.

What is claimed is:

1. A test clip for removable attachment to an IC package having protruding pins for mounting on a PCB, for providing electrical access via the test clip to the IC pins for electrical testing of the IC while mounted on the PCB and in service, comprising a shallow body comprised of electrically insulating material and having side surfaces and at a bottom surface a cavity dimensioned to fit over the IC package while mounted on the PCB, a plurality of substantially fixed clip contact pins of spring metal extending through the body and having lower ends exposed within the cavity and positioned to make respective electrical contact with the IC pins when the clip is slid over and attached to the IC package, user-actuable means mounted on the body and separated from the clip contact pins for selectively locking and unlocking the clip to and from the IC package, said locking means being positioned to avoid contact with the IC pins when the clip is attached to the IC, and a flat multi-conductor cable connected to and extending laterally outwardly from a side surface of the body and having its conductors connected within the body to respective clip contact pins, said cable having at its free end means by which electrical access may be had to the IC pins via the cable conductors and clip contacts.

2. An IC test clip as claimed in claim 1, wherein the lower ends of said clip contacts are slightly laterally displaceable on contacting the IC pins and establish a slight spring tension on the contacted IC pins, and the body has a generally U-shaped cross-section defining opposed cavity side walls having narrow slots each accommodating the lower end of one of the clip contacts arrayed in parallel rows, said contact pins lower ends being slightly spaced from the inner slot walls.

3. A test clip as claimed in claim 1, wherein the means at the cable free end comprises a remote connector.

4. A test clip as claimed in claim 3, wherein the clip contact pins are parts of a cable connector similar to the remote cable connector, and the clip contact pin cable connector is incorporated within the body.

5. A test clip as claimed in claim 4, wherein the body has side walls configured to receive and space the clip contact pins so as to be aligned with the IC pins.

6. A test clip as claimed in claim 5, wherein the cable connector incorporated within the body is secured therein by glue means.

7. An IC test clip as claimed in claim 1 wherein the locking means comprises spring-biased metal members located at opposite ends of the body and each member having an inwardly-directed metal tab positioned to fit underneath an end of the IC package spaced inwardly from the IC pins when the clip is attached.

8. An IC test clip as claimed in claim 7 and further including means for pivotably mounting of the said spring-biased members on the said body.

9. A test clip as claimed in claim 7, wherein the overall height of the body is about one-half inches.

10. An IC test clip for electrical testing of an IC package while mounted on a PCB and in service, comprising a flat multi-conductor cable having first and second multi-pin connectors at opposite ends, corresponding pins of the first and second connectors being interconnected by a cable conductor, an insulated housing having side and end walls and having a cavity defined by the side and end walls and a top wall of the housing, said first connector being mounted within the housing such that the first connector pins extend into and are exposed within the cavity and the flat cable extends laterally outwardly from a side wall of the housing, and metal spring clips mounted on the housing end walls for selectively locking and unlocking of the clip to the IC package, said locking spring clips being located in a position spaced from and unconnected to the first connector pins, said housing top wall being free of electrical connections to the first connector pins.

11. An IC test clip as claimed in claim 10 wherein the first and second connectors are each male plugs with two parallel pin rows, the cable extends laterally sidewise from both the first and second connectors and also extends laterally sidewise through an opening in the housing.

12. An IC test clip as claimed in claim 11 wherein the housing is generally rectangular with opposed side walls and opposed end walls, and the inner surfaces of the housing side walls are configured to provide separated slots each for receiving one of the first connector pins.

13. An IC test clip as claimed in claim 12 wherein each spring clip comprises a generally flat metal spring frame with a centrally disposed tang extending inwardly from the plane of the frame and engaging the adjacent housing end wall and with an inwardly bent tab extending over the housing cavity.

* * * * *